US005490807A

United States Patent [19]

Marchell

[11] Patent Number: 5,490,807

[45] Date of Patent: Feb. 13, 1996

[54] SAND-BLAST SIGN-MAKING APPARATUS

[76] Inventor: Ted Marchell, 4 Hall Rd., Ithaca, N.Y. 14850

[21] Appl. No.: 141,528

[22] Filed: Oct. 27, 1993

[51] Int. Cl.[6] ..... B24C 3/04

[52] U.S. Cl. ..... 451/3; 451/442; 451/29; 451/89

[58] Field of Search ..... 51/426, 415, 416, 51/310, 311, 312, 262 R; 451/89, 2, 3, 29, 30, 31, 442

[56] References Cited

U.S. PATENT DOCUMENTS

| | | | |
|---|---|---|---|
| 1,500,272 | 7/1924 | Sanborn et al. | 51/312 |
| 1,594,603 | 8/1926 | Chase | 51/312 |
| 1,783,828 | 12/1930 | Chase | 51/312 |
| 1,869,427 | 8/1932 | Jones | 51/312 |
| 1,882,541 | 10/1932 | Billman | 51/426 |
| 2,016,092 | 10/1935 | Kavanaugh | 41/39 |
| 2,109,000 | 2/1938 | Waldo, Jr. | 41/39 |
| 2,358,710 | 9/1944 | Helgeson | 41/39 |
| 2,953,876 | 9/1960 | Zieber et al. | 51/415 |
| 3,104,499 | 9/1963 | Hirons | 51/415 |
| 3,137,978 | 6/1964 | Incantalupo | 51/312 |
| 3,436,866 | 4/1969 | Nye | 51/416 |
| 3,550,321 | 12/1970 | Dye, Jr. | 51/416 |

*Primary Examiner*—Robert A. Rose
*Attorney, Agent, or Firm*—Charles S. McGuire

[57] ABSTRACT

A sand-blast sign-making apparatus for forming a plurality of horizontally extending and alternating grooves and peaks on the planar front surface of a degradable blank of synthetic substrate material having a non-degradable stencil removably applied thereto. The grooves and peaks are formed in the portions of the blank surrounding the stencil and are intended to simulate a naturally weathered or sand-blasted piece of wood with the peaks representing the hardest grains in the wood. A sand-blast hose is supported upon a carriage assembly which is movable simultaneously in both the horizontal and vertical directions. The hose is directed at the blank and a grille having a plurality of stock blades positioned in spaced, parallel planes is positioned between the hose and the blank. The grille is at least as high as the blank and is attached to and movable in the horizontal direction with the carriage assembly such that the sand-blast stream is directed through the spaces between the blades in the grille before it impinges upon the blank. As such, the sand passing through the spaces between the blades forms horizontally extending and spaced grooves in the blank which align with the spaces in the grille. The spacing between each blade and the thicknesses of the blades vary to more closely simulate the grains in a real piece of wood which has been naturally weathered or sand-blasted.

22 Claims, 6 Drawing Sheets

SAND-BLAST SIGN-MAKING APPARATUS

BACKGROUND OF THE INVENTION

This invention relates to sign-making apparatus which makes signs by using a sand-blast on a blank of degradable material and, more particularly, to such apparatus which is operable to degrade a synthetic blank in a fashion which gives the blank the appearance and texture of sand-blasted, or naturally weathered wood.

Sign-making apparatus using a sand-blast involves taking a substantially planar blank of substrate material which is degradable and applying a non-degradable stencil thereto. The sand-blast is directed at the stationary substrate and moved in both the vertical and horizontal directions to degrade the substrate surrounding the stencil. The stencil is then removed leaving raised areas forming the design and/or lettering of the stencil outline on the substrate such that it contrasts and is visually perceivable apart from the degraded portions of the substrate. This type of sign-making is described in the following U.S. Pat.:

U.S. Pat. No. 2,016,092 to Kavanaugh on Oct. 1, 1935;

U.S. Pat. No. 2,109,000 to Waldo, Jr. on Feb. 22, 1938;

U.S. Pat. No. 2,358,710 to Helgeson on Sep. 19, 1944; and

U.S. Pat. No. 3,137,978 to Incantalupo on Jun. 23, 1964.

The Kavanaugh method relates to the formation of a non-degradable stencil from a latex rubber compound. An example of a substrate is wood to which the stencil is applied and sand-blasted resulting in grooves being formed in the wood parallel with the grain of the wood. The resultant grooves in the wood give the wood a weathered appearance which is a highly desirable effect.

The Waldo, Jr. method relates to treating a wood plank with shellac prior to the sand-blasting operation and also discusses the desirability of attaining a weather-beaten appearance due to the hard grains in the wood not being degraded to the same degree as the soft grains of wood.

The Helgeson invention and method relates to a method of preparing a rigid stencil and clamping the stencil against a substrate. There is no discussion as to types of substrate used or texture thereof as a result of the sand-blasting operation.

Lastly, the Incantalupo invention relates to a letter forming device used in sand-blasting on a stone medium.

The present invention concerns itself with the topography characteristics of the blank surface which has been subjected to the inventive sand-blast operation. In particular, it is generally desirable in the art to create parallel and alternating grooves and peaks in the sign surrounding the stencil, regardless of substrate material, which gives the sign a weathered appearance akin to wood which has either been naturally weathered, or subjected to a sand-blast, both of which act to augment the harder grains in the wood (which are formed during the slower, summer growth period of tree development) by degrading the softer grains thereof (which are formed during the quicker, spring growth period of tree development) located between the harder grains.

SUMMARY OF THE INVENTION

It is a principal object of the present invention to provide a sand-blast sign-making apparatus which is operable to create grooves in the portions surrounding a non-degradable stencil applied to a degradable substrate to give the appearance of sand-blasted or weathered wood.

It is a further object of the present invention to provide a sign-making apparatus of the above type which creates parallel grooves of varying depths and widths in the substrate to resemble the appearance of naturally weathered or sand-blasted wood as closely as possible.

It is another object of the present invention to provide a sign-making apparatus of the above type which is readily adjustable to accommodate and act on a potentially limitless variety of substrates having varying heights, widths and thicknesses.

It is yet a further object of the present invention to provide a sign-making apparatus of the above type which is positioned within a dust-proof enclosure, the control panel of which is located exteriorly of the enclosure such that a person may operate the apparatus in a substantially dust-free environment.

Other objects will in part be obvious and in part appear hereinafter.

In accordance with the foregoing objects, the present invention comprises a sand-blast sign-making apparatus having a sand-blast hose and nozzle supported upon a carriage assembly which is simultaneously movable in both horizontal and vertical directions. A work-piece mounting framework is provided forwardly of the sand-blast nozzle and includes movable clamping members for removably securing a planar work-piece material of predetermined height and width thereon in a plane spaced and parallel to the plane in which the sand-blast carriage moves.

The work-piece of choice used to make the sign with the novel sand-blasting apparatus is a synthetic material comprising an isocyanate and polyol compound which is degradable yet exhibits superior strength and durability. The material is molded and cured into a closed-cell, rigid blank which may be further cut to any desired dimensions, the face thereof on which the lettering and/or design is to appear by the sand-blasting operation being formed substantially planar.

An elongated grille framework is positioned between the work-piece and the sand-blast nozzle and is attached to and movable in the horizontal direction with the sand-blast carriage. The grille framework extends the full height of the work-piece and comprises a plurality of elongated, planar metal stock blades arranged in spaced, parallel planes. The opposite ends of the stock blades are removably secured in aligned slots formed in laterally spaced relation in first and second, elongated side members. The slots in the side members are unequally spaced apart such that the spaces between each adjacent stock blade are of varying widths. Furthermore, the individual stock blades are of varying thicknesses thus giving the finished work-piece a truly natural appearance as will be understood more fully below.

The grille framework is positioned with the planes of the individual stock blades lying perpendicular to the work-piece such that the sand stream from the sand-blast nozzle passes through the spaces between each adjacent stock blade to impinge upon the work-piece. Since the spaces are of varying widths, the sand striking and degrading the work-piece (about the stencil) forms parallel grooves therein which are also of varying widths, depths and distances apart. And, since the blades are of varying thicknesses and act to repel the sand-blast at their positions, parallel peaks are formed in the work-piece (between the grooves) in alignment with the blades, the widths of which also vary in direct correlation to the thickness of their respectively aligned blades. This produces an effect which very closely resembles the grooves and peaks found in a naturally weathered or sand-blasted plank of wood.

DETAILED DESCRIPTION

Figure 1A:
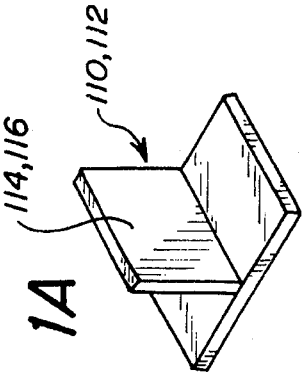
FIG. 1A is a perspective view of one of the carriage horizontal stop members seen in FIG. 1.
Figure 1:
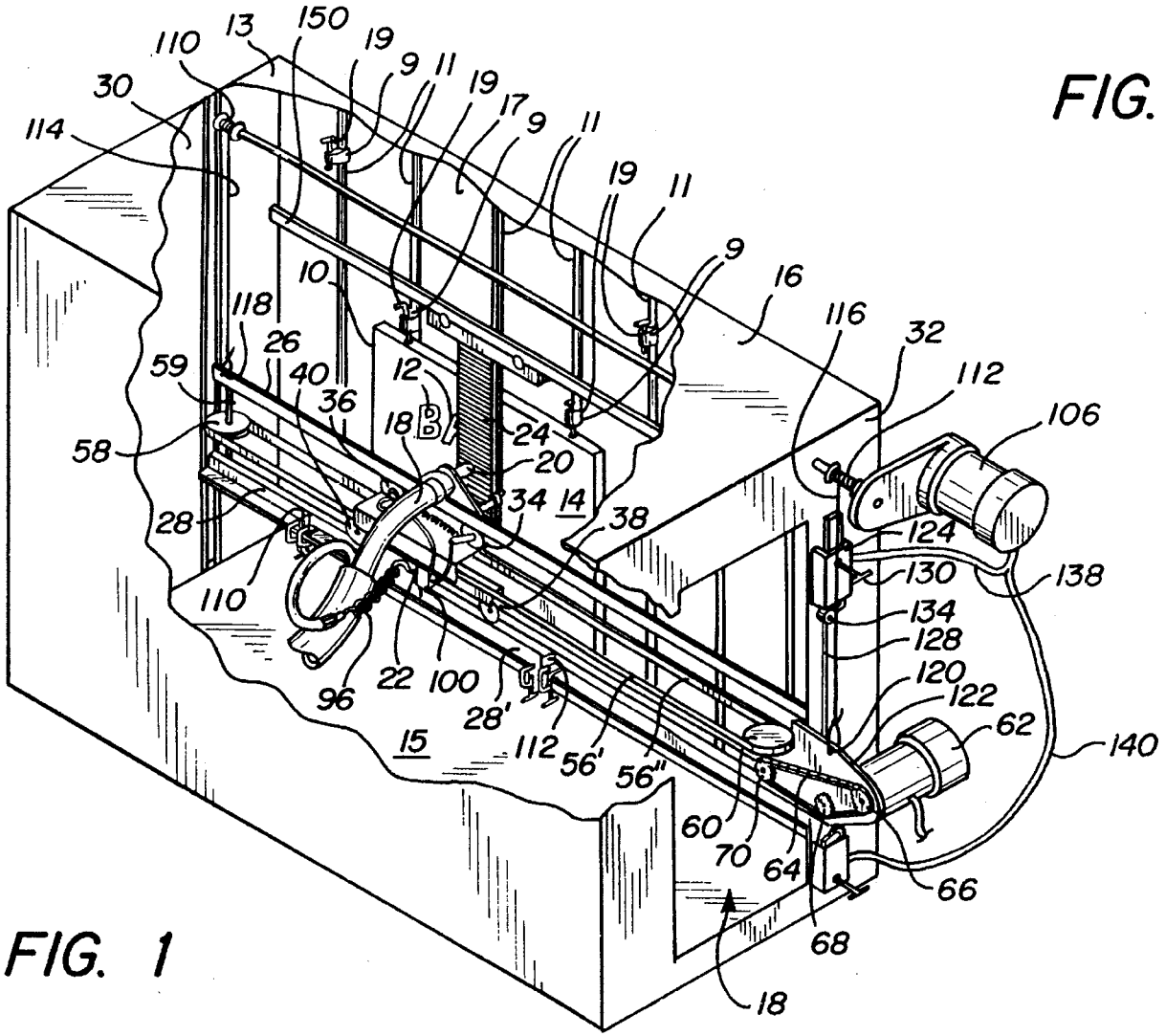
FIG. 1 is a perspective view of the sign-making apparatus positioned within an essentially sand-proof enclosure.

Referring now to the drawings, there is seen in FIG. 1 the inventive sand-blast sign-making apparatus for making signs on a work-piece blank 10 made of a synthetic substrate material which is preferably comprised of an isocyanate/polyol compound. This compound is mixed in liquid form and poured into a mold in which it cures into a closed-cell material which is rigid and durable yet degradable by a sand-blasting operation such as carried out by the present invention. Blank 10 may be cut to the desired dimensions and is preferably cut about 1½" thick and may be of any outline depending on the sign design, such as the rectangular outline of blank 10. The substrate described herein is for purposes of description only since it produces superior results when subjected to the inventive sand-blasted apparatus. It is understood, however, that the substrate may be any degradable material suitable for sign-making.

A non-degradable, rubber stencil 12 having a pressure-sensitive, adhesive backing is removably secured to the front surface 14 of blank 10, which surface is substantially smooth and planar prior to it being acted upon by the sign-making apparatus. As will be set forth more clearly below, the sign-making apparatus is operable to degrade those portions of the front surface 14 of blank 10 surrounding stencil 12 to give the appearance of naturally weathered or sand-blasted wood which is characterized by a plurality of longitudinally extending and alternating, parallel grooves and peaks, the peaks of which represent the hardest grains in the wood. Since the individual grains found in a single piece of wood are usually not of the exact same hardness, the grooves formed in the wood from weathering or sand-blasting are of unequal depths and widths. The present invention degrades the blank 10 by forming longitudinally extending and alternating, parallel grooves and peaks therein which are also of unequal depths, heights and widths, thereby very closely resembling a naturally weathered or sand-blasted piece of wood.

In FIG. 1, it is seen that the majority of the sign-making apparatus is housed within a walk-in enclosure 16 having a doorway 18 (the door itself is not shown for clarity). All controls for operating the sign-making apparatus (also not shown) are located externally of enclosure 16 such that the sign-making process can be carried out with the operator located outside enclosure 16 and essentially all of the sand remaining within enclosure 16. The sign-making apparatus generally comprises a sand-blast hose and nozzle 18 and 20, respectively, which attach to a carriage assembly 22, which itself is movable in a first plane in both the horizontal and vertical directions, and a grille framework 24 which is attached to and horizontally movable with the carriage assembly 22. The grille framework 24 is positioned between the sand-blast nozzle 20 and sign blank 10 and provides a plurality of horizontally extending, parallel slots wherethrough the sand-blast stream passes to impinge upon and degrade sign blank 10 in the manner described above.

A plurality of elongated pole members 11 are mounted in vertically oriented, parallel, and laterally spaced relationship against enclosure back wall 17, and extend from the ceiling 13 to floor 15 thereof. An equal plurality of screw-type clamping members 19 are slidingly positioned by a collar 9 on a respective pole member 11. As seen best in FIGS. 2 and 4, a horizontally extending ledge 21 is attached to and extends forwardly adjacent the bottom of each pole member 11 upon which the bottom edge 23 of blank 10 is supported. The clamping members 19 on the pole members 11 may then be brought into clamping engagement with the top edge 25 of blank 10 thereby securing blank 10 in place during the sand-blast operation.

Carriage 22 is slidingly supported between a pair of interconnected, vertically spaced, upper and lower guide rails 26 and 28, respectively. Guide rails 26 and 28 are of V-shaped cross-section with carriage 22 including a pair of laterally spaced, upper and lower guide wheels 34, 36 and 38, 40, respectively, each of which are grooved about their circumference to slidingly engage the upper and lower guide rails, respectively.

Figure 5:
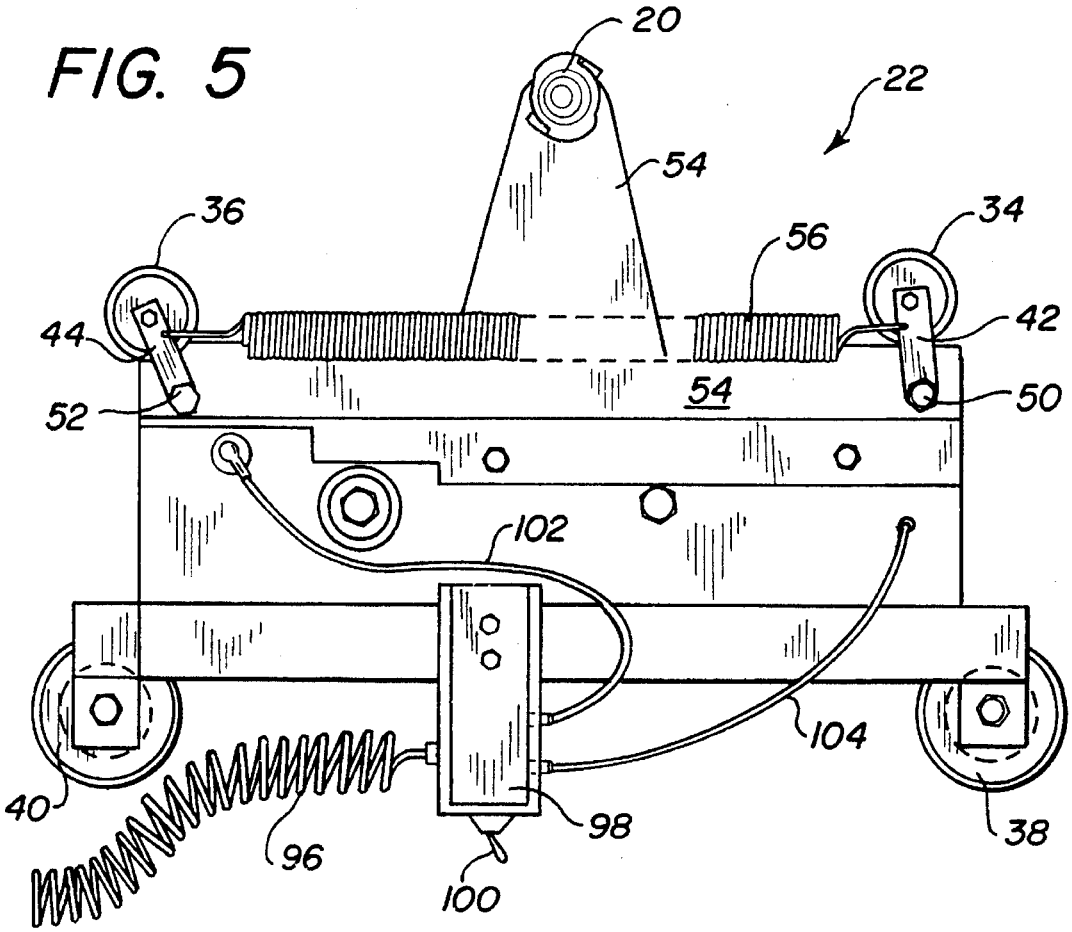
FIG. 5 is a rear, elevational view of the carriage assembly.

Upper wheels 34, 36 are rotatably mounted between the first ends of respective connecting arms 42, 42' and 44, 44', the second ends of which are anchored (e.g., by welding) to respective sleeves 46 and 48 (sleeve 48 not shown), which themselves are mounted upon bolt members 50 and 52, respectively. The ends of bolt members 50 and 52 extend through respective apertures formed in central carriage frame plate 54 with sleeves 46 and 48 being freely rotatable thereon such that arms 42, 42' and 44, 44' may pivot about the longitudinal axes of bolts 50 and 52, respectively. A spring 56 is attached at either end thereof to arms 42 and 44 (FIG. 5) thereby biasing wheels 34 and 36 toward one another. This, in turn, biases wheels 34 and 36 against upper rail 26 thereby securely maintaining carriage assembly 22 between the upper and lower guide rails 26 and 28 as it travels therealong.

As seen in FIG. 1, an endless belt having first and second runs 56' and 56" is positioned in parallel relationship to and between upper and lower guide rails 26 and 28, respectively, and is trained about grooved wheels 58 and 60 which are rotatably mounted adjacent enclosure side walls 30 and 32, respectively. Wheels 58 and 60 each lie in a common, horizontal plane and are rotatable about parallel, vertical axes whereby belt runs 56' and 56" move in opposite directions along a common, horizontal plane. A motor 62 located externally of enclosure 16 drives wheel 60 via chain 64 and gears 66, 68 and 70, with wheel 58 being an idler. Wheel 60 and gear 70 are mounted upon intersecting shafts which have meshing bevel gears on their intersecting ends (not shown), thereby transferring the rotational movement of gear 70 to wheel 60. Wheel 58 is freely rotatably mounted upon a shaft 59 which is secured to and interconnects upper and lower guide rails 26 and 28.

Figure 6:
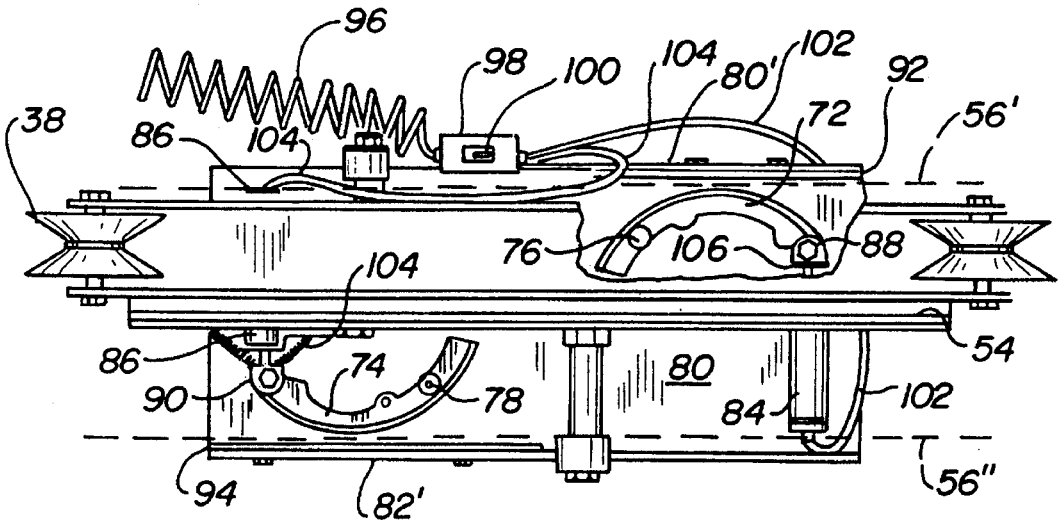
FIG. 6 is a bottom plan view of the carriage assembly with portions thereof broken away to show the rear arcuate member.
Figure 8:
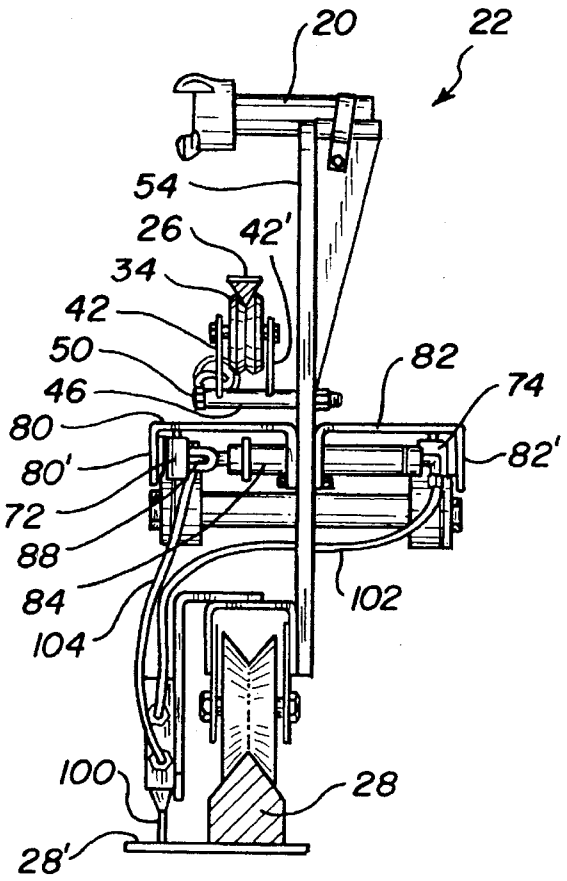
FIG. 8 is a side, elevational view of the carriage assembly.
Figure 7:
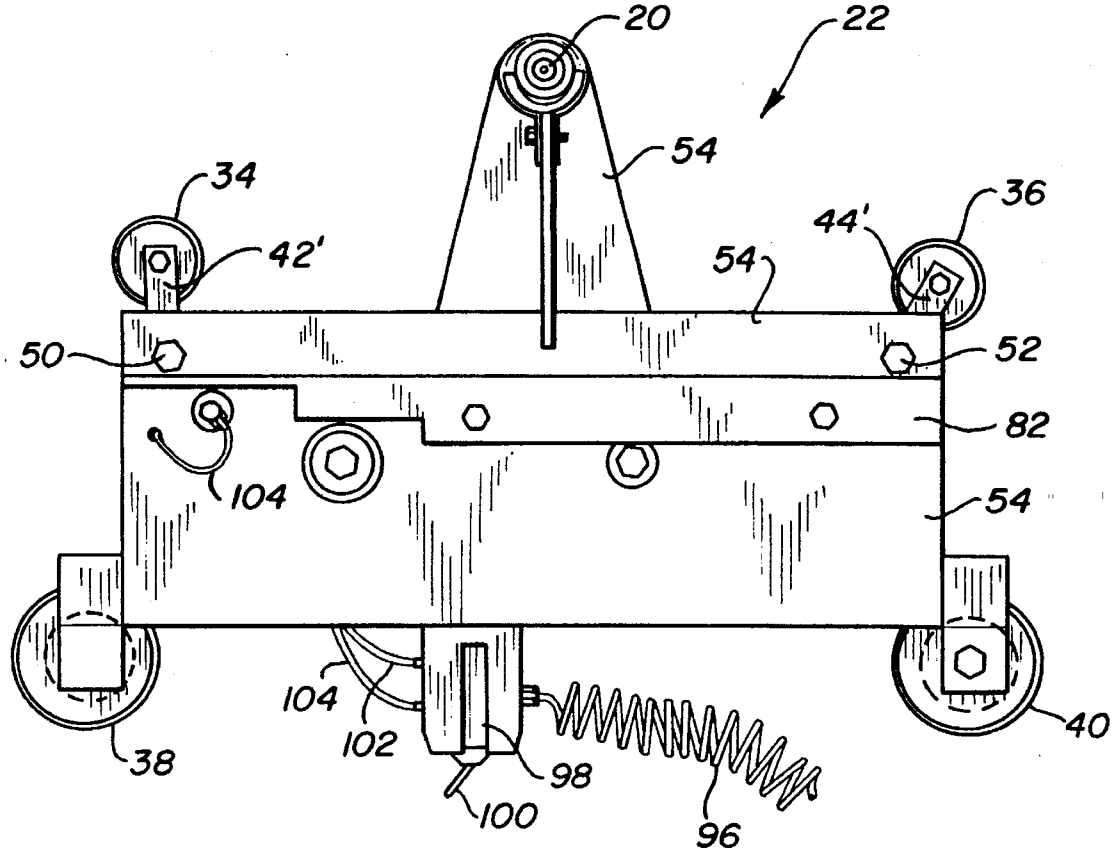
FIG. 7 is a front, elevational view of the carriage assembly.

As seen most clearly in the side and bottom plan views of FIGS. 8 and 6, respectively, carriage 22 includes arcuate bearing members 72 and 74 which are pivotally mounted by bolts 76 and 78 to the bottom surfaces of carriage U-shaped brackets 80 and 82, respectively, which brackets are seen in FIG. 8 to be perpendicularly attached to opposite sides of the central frame plate 54 below the point of attachment of nozzle 20. The convex surfaces of arcuate members 72 and 74 face outwardly in opposite directions of each other and lie closely adjacent the outer, downwardly depending flange portions 80' and 82' of brackets 80 and 82, respectively. The ends of arcuate members 72 and 74 opposite their pivotal attachment ends are attached to the piston end of a pneumatic ram 84 and 86 by a U-shaped bracket 88 and 90, respectively. With the upper guide wheels 34, 36 and 38, 40 mounted upon upper and lower guide rails 26 and 28, respectively, as seen in FIGS. 1, 2, 4 and 8, belt runs 56' and 56" are inserted between arcuate member 72 and bracket flange 80', and arcuate member 74 and bracket flange 82', respectively. Padding strips 92 and 94 are attached to the inner surfaces of bracket flanges 80' and 82', respectively, and comprise a material having a high co-efficient of friction. As such, belt runs 56' and 56" are firmly engaged between their respective arcuate member and bracket flange 72, 80' and 74, 82' when their respective arcuate member is moved to the engaged position by its respective pneumatic ram 84, 86 in the manner described below.

More particularly, the piston ends of pneumatic rams 84 and 86 are movable between extended and retracted positions which, in turn, move arcuate members 72 and 74 between engaged and released positions, respectively. Rams 84 and 86 are of the single-action type and include internal springs (not shown) which bias the piston ends thereof in the retracted position. A source of compressed air (also not shown), is delivered through a main air line 96 to a two-way air switch 98 having a toggle 100. Air lines 102 and 104 connect to switch outlet ports 106 and 108 at first ends thereof, and to the cylinder ends 110 and 112 of pneumatic rams 84 and 86 at second ends thereof, respectively. Thus, when toggle switch 100 is moved to a first position, air is forced through a first of the two air lines 102 and 104 while the other air line is vented to the ambient, and when toggle switch 100 is moved to a second position, air is forced through the second of the two air lines while the first air line is vented to the ambient. When toggle 100 is in a first position, air is forced through air line 102 which forces the piston of pneumatic ram 84 to be moved to the extended position which pivots arcuate member 72 against padding strip 92 thereby firmly engaging belt run 56' therebetween. Likewise, when toggle 100 is moved to a second, opposite position, air is vented from line 102 and is forced through line 104. This causes the piston of pneumatic ram 86 to move to the extended position which pivots arcuate member 74 against padding strip 94 thereby firmly engaging belt run 56" therebetween. As mentioned above, the piston ends of pneumatic rams 84 and 86 are biased in the retracted positions by internal springs, and also by external "helper" springs 106 and 108, if needed, such that arcuate members 72 and 74 are pulled away from padding strips 92 and 94 upon the venting of air lines 102 and 104, respectively, which thereby releases belt run 56' and 56", respectively.

Figure 4:
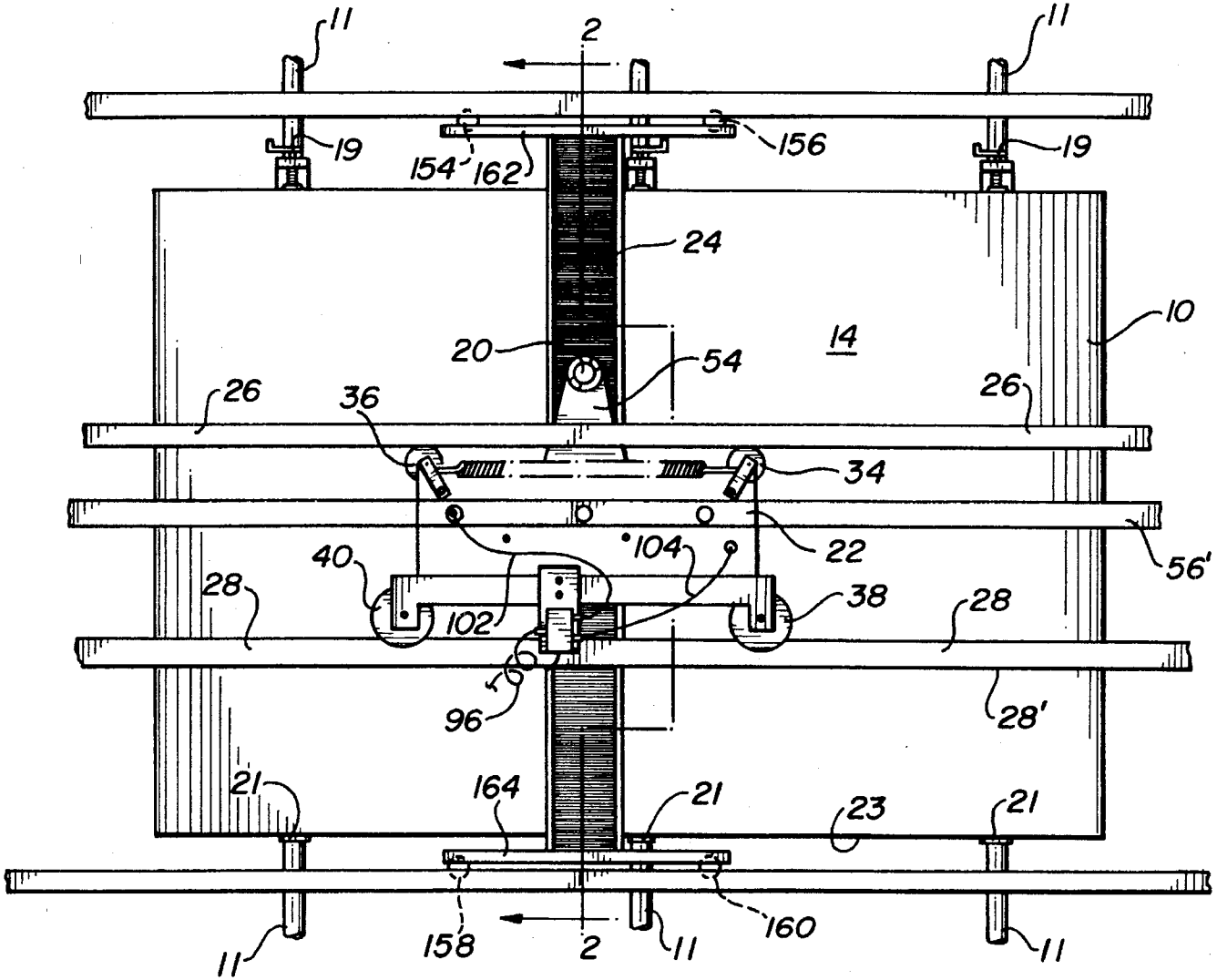
FIG. 4 is a front, elevational view of FIG. 2.

As seen in FIGS. 1 and 1A, a pair of left and right, rubber I-shaped stop members 110 and 112, respectively, are clamped to the outwardly projecting ledge portion 28' of lower rail 28 with the center flange portions 114 and 116 thereof extending upwardly therefrom in a plane perpendicular to the horizontal directional movement of carriage 22 along rails 26 and 28. With motor 62 turning wheel 60 in the clockwise direction, belt runs 56' and 56" also together travel in the clockwise direction. As such, belt run 56' moves to the left in FIGS. 1 and 4 while belt run 56" moves to the right. With toggle 100 moved to the left as seen in FIG. 4, air is forced through line 102 via switch 98 thereby moving the piston of pneumatic ram 84 to the extended position which moves arcuate member 72 about pivot 76 and against padding strip 92, thereby firmly engaging belt run 56' therebetween. Since air line 104 is vented, arcuate member 74 is moved away from padding strip 94 whereby the entire carriage assembly 22 rides upon belt run 56' which is traveling to the left.

When carriage 22 reaches left stop member 110, toggle 100 hits the center flange portion 114 thereof which thereby moves toggle 100 to the right. This causes switch 98 to vent air line 102 while simultaneously forcing air through air line 104. This, in turn, causes the piston of pneumatic ram 84 to move to the retracted position which releases belt run 56' from between padding strip 92 and arcuate member 72, while the piston of pneumatic ram 86 moves to the extended position which engages belt run 56" between padding strip 94 and arcuate member 74. The entire carriage assembly 22 thus rides upon belt run 56" which is traveling to the right. When carriage 22 reaches right stop member 112, toggle 100 hits the center flange portion 116 thereof which thereby moves toggle 100 to the left causing carriage 22 to switch directions again.

It may thus be appreciated that carriage 22 travels in repeating, alternating, horizontal directions as long as wheel 60 turns the belt and compressed air is delivered through line 96.

As previously mentioned, the present sign-making apparatus is operable to degrade these portions of the front face of blank 10 surrounding the stencil 12 to create a sand-blasted or weathered wood appearance. It is thus required that sand-blast nozzle 20 be directed to cover the entire surface area of the front face of a blank of sign material. Thus, besides moving quickly in the horizontal direction, carriage assembly 22 also travels more slowly in the vertical direction. In this regard, it is seen in FIG. 1 that a second motor 106 is mounted above motor 62 adjacent the roof of enclosure 16. Motor 106 is connected to, and operable to rotate, a drive shaft 108 which extends from motor 106, through an aperture formed in enclosure side wall 32, and extends the full internal length of enclosure 16 with the end thereof opposite motor 106 attaching to opposite enclosure side wall 30. First and second spindles 110 and 112 are mounted upon drive shaft 108 adjacent either end thereof with spindle 112 being positioned externally of enclosure 16 between motor 106 and enclosure side wall 32. First and second lengths of flexible cable 114 and 116 are wound upon spindles 110 and 112, respectively, with the free ends thereof being tied through apertures 118 and 120 formed in the left end of upper guide rail 26, and in the plate 122 on which motor 62 and gears 66, 68 and 70 are mounted, respectively.

Referring still to FIG. 1, it is seen that a pair of upper and lower brackets 124 and 126, respectively, are slidingly mounted upon a rail 128 which is anchored in vertical orientation to the outer surface of enclosure side wall 32 adjacent to doorway 18. A respective pair of manually turnable set screws 130 and 132 extend through brackets 124 and 126 to frictionally engage rail 128 and locate brackets 124 and 126 in the desired vertical position thereon for reasons explained below.

A pair of two-way limit switches 134 and 136 are mounted to and carried by brackets 124 and 126 and electrically connect to motor 106 via electric wires 138 and 140, respectively. Limit switches 134 and 136 are operable to control the directional movement of motor 106 and thus also the directional movement of drive shaft 108. In particular, when drive shaft 108 is caused to rotate in the counter-clockwise direction as viewed in front of enclosure side wall 32, cables 114 and 116 unwind from spindles 110 and 112, respectively, thereby lowering plate 122 and upper guide rail 26 (and thus all parts connected thereto including carriage assembly 22). When plate 122 reaches lower bracket, it strikes and moves limit switch 136 which changes the directional movement of motor 106 and thus also drive shaft 108 to rotate in the clockwise direction. This causes cables 114 and 116 to be wound upon spindles 110 and 116 thereby lifting plate 122 and upper guide rail 26. When plate 122 reaches upper bracket 124, it strikes and moves limit switch 134 which again changes the directional movement of motor 106 and thus also drive shaft 108 to rotate in the counterclockwise direction thereby lowering the plate 122 and upper guide rail 26.

The vertical lifting and lowering of the guide rails 26 and 28 and carriage assembly 22, as controlled by motor 106 and limit switches 134 and 136, is simultaneous with the horizontal movement of carriage assembly 22 upon rails 26 and 28, as controlled by motor 62 and stop members 110 and 112, thereby enabling nozzle 20 to cover substantially the entire surface area of the front surface 14 of blank 10. In this regard, it is noted that blank 10 may vary in height and width and, as such, the vertical and horizontal distances of travel of the carriage assembly 22 must also be able to vary. This is very easily accomplished by un-clamping and moving stop members 110 and 112 either closer together or farther apart on lower guide rail ledge 28' to adjust the horizontal distance of travel of carriage 22, and by releasing set screws 130 and 132 and moving brackets and limit switches 124, 134 and 126, 136 either closer together or farther apart on rail 128 to adjust the vertical distance of travel of carriage 22.

Furthermore, to ensure the desired degrading effect of closely adjacent, horizontally extending grooves and peaks, it is necessary that carriage assembly 22 move much faster horizontally than vertically. To achieve the desired effect using different sized and types of blanks, motors 62 and 106 are of the DC type to permit adjustment to the rotational speeds thereof. It has been found that a horizontal speed of up to approximately 10 ft./sec. is optimal for blanks having widths in the 2 to 10 foot range, and that a vertical speed of up to approximately 5 ft./min. is optimal for blanks having heights up to 10 feet. The total number of horizontal passes carriage 22 makes across the blank may thus be varied by varying the speeds of motors 62 and 106 which allows the user to make adjustments depending on such factors as the density of the blank material and overall dimensions thereof.

Attention is now turned to grille 24 which, as mentioned above, enables the sand-blast emitted from nozzle 20 to degrade blank 10 while forming parallel grooves and peaks therein which simulates a sand-blasted or weathered piece of wood. It is thus necessary that grille 24 remain positioned between blank 10 and nozzle 20 as carriage 22 moves in both the horizontal and vertical directions.

Figure 3:
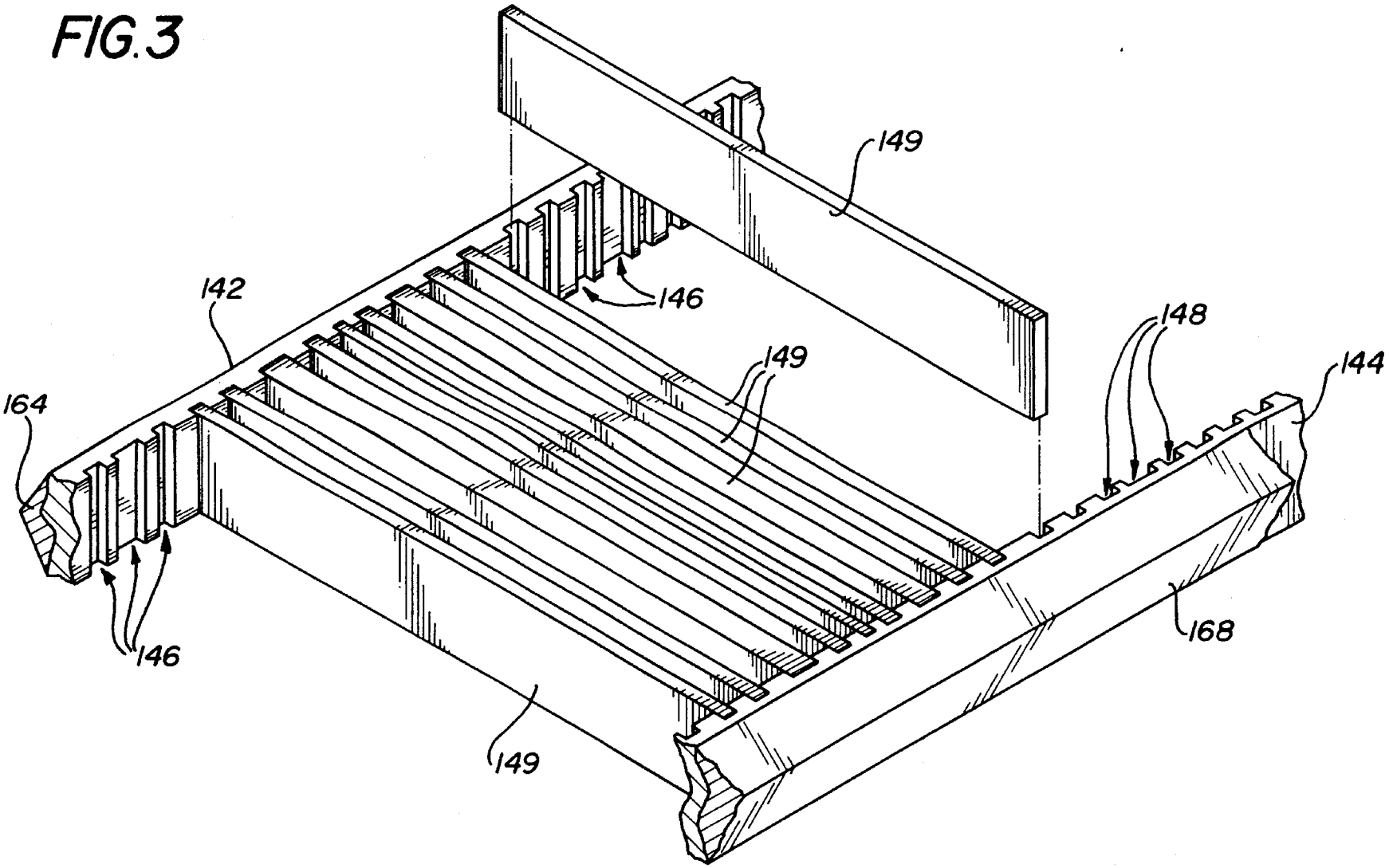
FIG. 3 is a fragmented, perspective view of the grille framework of FIGS. 1 and 2 with one of the planar stock blades shown in spaced relation thereto.

As seen in FIG. 3, grille 24 comprises first and second, elongated side members 142 and 144 of rectangular cross-section, each of which include a plurality of longitudinally spaced, parallel grooves 146 and 148, also of rectangular cross-section, formed on the inwardly facing surfaces thereof, respectively. Each groove 146 in side member 142 is aligned with a respective groove 148 in side member 144. A rectangular, planar grille blade 149 is securely fit into and between each aligned pair of grooves 146 and 148 such that the blades 149 lie in spaced, parallel planes to one another.

The sand-blast stream from nozzle 20 is directed through grille 24 with the sand passing therethrough between each blade 149. Thus, the spacing between each blade 149 aligns with the grooves formed in the blank 10 while the blades 149 align with the peaks formed between each groove in the blank 10.

It will be noticed that the distance between each successive groove 146 and 148 in side members 142 and 144 is varied such that the distance between each successive grille blade 149 is also varied. Also, the thicknesses of the blades 149 vary (and thus the widths of the grooves 146 and 148 into which they fit). This varying of the widths and distances between the grille blades 149 provides for a like varying of the widths, depths and distances between successive grooves and peaks in the finished blank 10, as will be understood more clearly below. This closely simulates the same type of varied spacing found between the grooves and peaks formed in a naturally sand-blasted or weathered piece of wood. In the preferred embodiment, there are provided blades of four different thicknesses and distances apart ranging from approximately 0.05 to 0.125 inch.

Figure 2B:
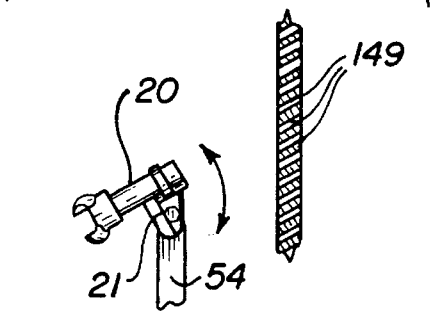
FIG. 2B is a fragmented, side elevational view of the sand-blasted nozzle and an alternate embodiment of the grille framework.

Furthermore, as seen in FIG. 2B, it may be desirable to angle the peaks and grooves formed in the blank 10 which is accomplished by positioning blades 149 (and thus grooves 146 and 148) at an angle with respect to side members 142 and 144. In this instance, nozzle 20 is provided with a pivoting bracket 21 so that the sand-blast stream is still directed along a plane parallel to the blades 149 and spaces therebetween.

Figure 2:
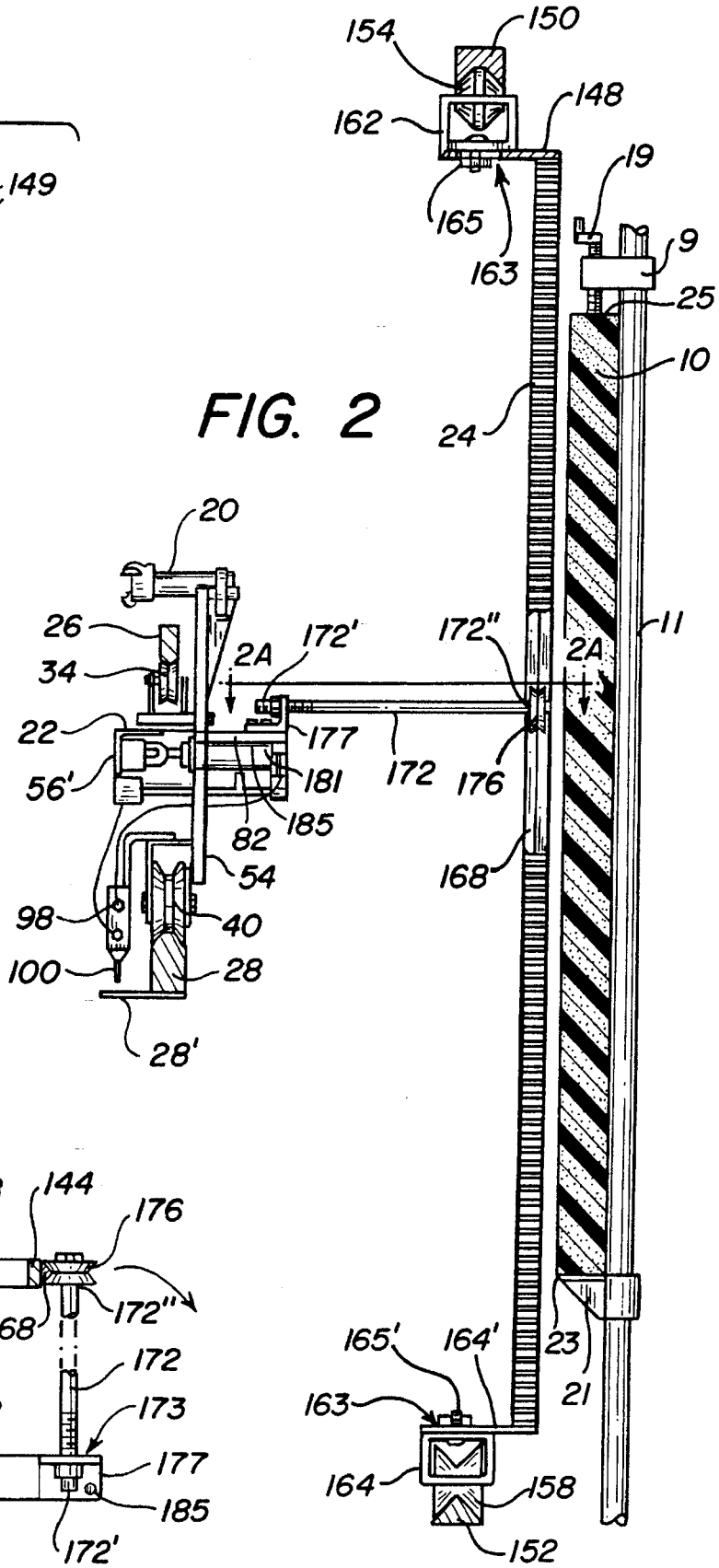
FIG. 2 is a cross-sectional view of the sand-blast carriage, work-piece, and grille framework positioned therebetween as taken along the line 2—2 in FIG. 4.

As seen in FIGS. 1, 2 and 4, grille 24 is mounted between another pair of upper and lower guide rails 150 and 152, respectively, which themselves are attached to and extend between enclosure side walls 30 and 32 at a location between clamp poles 11 and carriage assembly 22. Grille lower guide rail 152 is preferably positioned adjacent, and somewhat below, the bottom ledges 21 while the grille upper guide rail 150 is preferably somewhat below the drive shaft 108 with grille 24 traversing the full height of blank 10.

A pair of upper and lower guide wheels 154, 156 and 158, 160 are rotatably mounted upon elongated, square-shaped bracket members 162 and 164 attached to either end of grille 24 via plate members 162' and 164', respectively, which late members extend perpendicular to side members 142 and 144. Wheels 154, 156 and 158, 160 are positioned in sliding engagement upon grille upper and lower guide rails 150 and 152 such that grille 24 may move horizontally therealong.

Figure 2A:
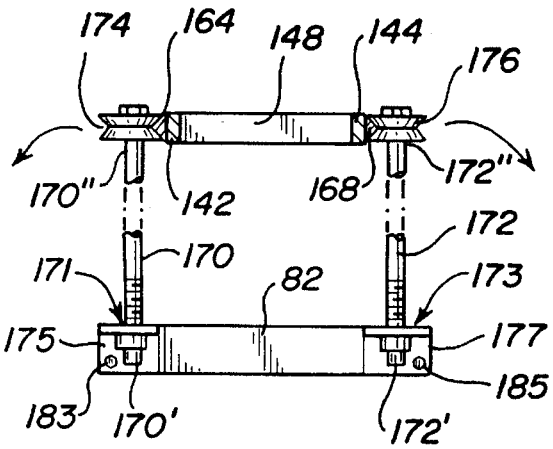
FIG. 2A is a fragmented, top plan view of the carriage roller arms and grille framework as taken along the line 2A—2A in FIG. 2.

As mentioned previously, grille 24 is attached to and movable horizontally with carriage assembly 22. In this regard, it is seen in FIG. 3 that a pair of elongated, wheel-engaging members 164 and 168 of V-shaped cross-section are attached in traversing, covering relation to the outwardly facing surface of grille side members 142 and 144, respectively. Referring to FIGS. 2 and 2A, it is seen that a pair of rods 170 and 172 are threadedly engaged at first ends 170' and 172' thereof into threaded apertures 171 and 173 formed in right-angle bracket pieces 175 and 177, respectively, with bracket pieces 175 and 177 being pivotally mounted to carriage bracket 82 by bolts 179 and 181, respectively (bolt 179 not shown). A pair of grooved guide wheels 174 and 176 are rotatably mounted upon the second ends 170" and 172" thereof and rotate about the longitudinal axis of its respective rod. Rods 170 and 172 are spaced apart a distance substantially equal to the width of grille 24 such that wheels 174 and 176 firmly engage the wheel-engaging members 164 and 168 on either side of grille 24. The bracket pieces 175 and 177 to which rods 170 and 172 attach may be pivoted about their bolt attachments to move rods 170 and 172 in directions away from each other in the direction of the arrows (FIG. 2A) to provide clearance when attaching or removing a blank from the poles 11. When bracket pieces 175 and 177 and rods 170 and 172 are in the spaced, parallel position seen in FIGS. 2 and 2A with wheels 174 and 176 in contacting, rolling engagement with grille wheel-engaging members 164 and 168, apertures formed in bracket pieces 175 and 177 and carriage bracket 82 are in direct alignment wherein a pin 183 and 185 may be inserted to effectively lock rods 170 and 172 in this operating position. When it is needed to rotate rods 170 and 172 away from each other as described above, pins 183 and 185 may be simply removed to rotate bracket pieces 175 and 177 upon carriage bracket 82.

It may thus be appreciated that as carriage assembly 22 moves in the horizontal directions, it forces grille 24 to move with it due to wheels 174 and 176 bearing directly against wheel-engaging members 164 and 168 in the direction of carriage movement. Also, as carriage 22 moves vertically, wheels 174 and 176 rotate vertically along wheel-engaging members 164 and 168. Thus, while grille 24 does not move vertically, carriage assembly 22 including nozzle 20 moves vertically along grille 24, and since grille 24 moves horizontally with carriage assembly 22 as described above, grille 24 is always maintained forwardly of nozzle 20.

As carriage assembly 22 moves simultaneously in the horizontal and vertical directions as described above, nozzle 20 ejects a stream of sand through grille 24 to impinge upon blank 10. With stop members 110 and 112 and limit switches 124 and 126 set to the width and height of blank 10, respectively, carriage 22 will move to eventually cover the entire surface area of front surface 14 of blank 10. When finished, surface 14 (excepting the portions covered by stencil 12), will be degraded with horizontally extending, parallel and alternating grooves and peaks of varying depths and distances apart substantially identical to the spacing between thicknesses of successively adjacent grille blades 149, respectively. The depths of the wider grooves will be deeper than the more narrow grooves since the time and amount of sand passing through a wider space between a pair of adjacent grille blades 149 will necessarily be longer and greater than the time and amount of sand passing through a narrower space in grille 24. This is so because the carriage assembly moves horizontally at a much greater rate than it travels vertically as previously mentioned.

While the present invention has been described and shown with particular reference to a preferred embodiment thereof, it will be appreciated to those skilled in the art that various modifications can be made thereto without departing from the full spirit and scope thereof as defined by the claims which follow.

What is claimed is:

1. An apparatus for making signs from a blank of degradable material having a substantially planar front surface; a removable, non-degradable stencil affixed to said blank front surface; and a sand-blast directed in a stream through a nozzle to impinge upon said blank front surface whereby said sand-blast degrades the portions of said blank front surface surrounding said stencil, said apparatus comprising:

a) a carriage assembly supporting and directing said nozzle at said blank front surface;

b) means moving said carriage with said nozzle in a first plane spaced and parallel to said front surface of said blank; and c) sand-blast divider means comprising a grille having a plurality of horizontally extending, vertically spaced elongated members positioned in a second plane spaced between said nozzle and said blank, said second plane lying parallel to said first plane and said blank front surface, the distance between said grille and said blank being adjustable, said sand-blast divider means operable to divide said sand-blast stream into at least two vertically spaced, sand-blast streams whereby said sand-blast streams degrade and form a plurality of vertically spaced, parallel grooves in said portion of said blank front surface surrounding said stencil.

2. The invention according to claim 1 and further comprising means supporting said blank front surface in a third plane parallel to said first and second planes.

3. The invention according to claim 1 wherein said carriage moving means moves said carriage assembly in simultaneous and reciprocating, horizontal and vertical directions in said first plane.

4. The invention according to claim 3 wherein said means moving said carriage assembly in said horizontal direction comprises:

a) an endless belt trained over first and second wheels which divide said belt into first and second belt runs extending between said wheels with said first and second belt runs spaced along a plane perpendicular to said first plane;

b) first motor means rotating said first and second wheels and said belt in a first direction whereby said first run moves in a direction opposite to said second run;

c) first and second clamping means attached to said carriage assembly and positioned adjacent to said first and second runs, respectively, and d) means automatically operable to alternately and simultaneously engage one of and disengage the other of said first and second clamping means to said first and second runs, respectively, whereby said carriage assembly is carried by and movable in the same direction as said engaged belt run.

5. The invention according to claim 4 wherein said first and second clamping means comprises:

a) first and second, spaced and parallel, stationary wall means attached to said carriage assembly and positioned adjacent said first and second belt runs, respectively; and b) first and second, arcuate-shaped members pivotally mounted to said carriage assembly adjacent said first and second wall means with said first and second belt runs extending therebetween, respectively.

6. The invention according to claim 5 wherein said means engaging one of and disengaging the other of said first and second clamping means comprises:

a) first and second pneumatic rams movable between extended and retracted positions and attached to said first and second arcuate-shaped members, respectively; and b) pneumatic ram actuator means operable to move said first and second pneumatic rams into said extended positions whereby said first and second arcuate-shaped members are pivoted into clamping engagement with said first and second belt runs and said first and second wall means, respectively.

7. The invention according to claim 6 wherein said pneumatic ram actuator means comprises:

a) first and second air conduits connected and providing air under pressure to said first and second pneumatic rams; respectively;

b) automatic switching means connected to said first and second air conduits, said automatic switching means movable in first and second positions to alternately provide said air under pressure to said first and second pneumatic rams, respectively; and c) first and second stop means removably positioned in longitudinally spaced relationship adjacent one of said first and second belt runs, said first and second stop means being operable to move said first automatic switching means to said first and second positions, respectively, upon said carriage assembly traveling along said one of said first and second belt runs and at least a portion of said first automatic switching means striking said first and second stop means.

8. The invention according to claim 4 wherein said apparatus further comprises upper and lower, vertically spaced and horizontally extending, interconnected guide rails positioned above and below said endless belt, respectively, said carriage assembly further including a pair of upper and lower guide wheels rotatably engaging said upper and lower guide rails, respectively, with said carriage assembly positioned between said upper and lower guide rails.

9. The invention according to claim 8 wherein said means moving said carriage assembly in said vertical direction comprises:

a) a horizontally extending drive shaft positioned above said upper guide rail;

b) first and second spindles positioned adjacent either end of said drive shaft;

c) first and second flexible cords attached at first ends thereof to said first and second spindles, respectively, and to and adjacent either end of said upper guide rail at second ends thereof, respectively; and d) second motor means operable to rotate said drive shaft in alternating clockwise and counter-clockwise directions whereby said first and second cords are wound and unwound upon said first and second spindles and said upper and lower guide rails including said carriage assembly is raised and lowered, respectively, by said first and second cords; and e) first and second limit switches electrically connected to said second motor means and positioned in vertically spaced relation adjacent one end of said upper and lower guide rails, said first and second limit switches being operable to rotate said drive shaft in said alternating clockwise and counterclockwise directions upon said upper and lower guide rails striking said first and second limit switches during movement in said vertical direction, respectively.

10. The invention according to claim 1 wherein said apparatus is positioned within a dust-proof enclosure.

11. The invention according to claim 1 wherein said grille is attached to and movable in the horizontal direction with said carriage assembly.

12. The invention according to claim 11 wherein said grille is of a height greater than said blank.

13. The invention according to claim 12 wherein said elongated members are of varying thicknesses and distances apart.

14. The invention according to claim 13 wherein said elongated members lie along spaced, parallel planes which lie perpendicular to said blank front surface.

15. The invention according to claim 13 wherein said elongated members lie along spaced, parallel planes which lie at an angle to said blank front surface.

16. The invention according to claim 11 wherein said grille includes first and second, elongated and vertically extending side members with said elongated members attached to and extending perpendicularly therebetween, and wherein said carriage assembly includes first and second rods pivotally attached thereto at first ends thereof, said first and second rods including first and second wheels rotatably mounted at second, opposite ends thereof, respectively, said first and second wheels being removably, rotatably engaged with said first and second grille side members, respectively.

17. Apparatus for forming a pattern in a front, abrasive-degradable surface of a substrate in surrounding relation to an abrasive-protected area of said front surface, said apparatus comprising:

a) means for holding said substrate in a fixed position;

b) an array of blocking members laterally spaced from one another and longitudinally spaced from said substrate front surface; and c) an abrasive-blasting nozzle directed toward and spaced from said array on the side thereof opposite said first plane, whereby traversing movement with respect to said array of a stream of abrasive from said nozzle degrades all unprotected areas of said front surface, those areas directly spaced from said blocking members being degraded to a lesser extent than areas directly spaced from spaces between said blocking members;

d) a carriage upon which said nozzle is mounted for maintaining said nozzle at a fixed distance from said array during said traversing movement, said array being mounted upon said carriage; and e) first motive means for moving said carriage, together with both said nozzle and said array, in at least a first direction relative to said fixed position and second motive means for moving said nozzle relative to said array to effect said traversing movement.

18. The apparatus of claim 17 wherein said first plane is substantially flat.

19. The apparatus of claim 17 wherein all of said blocking members are spaced by substantially the same distance from said first plane.

20. The apparatus of claim 17 wherein at least one adjacent pair of said blocking members are laterally spaced from one another by a distance different from the lateral spacing of another adjacent pair of said blocking members.

21. The apparatus of claim 17 wherein said blocking members are substantially laterally parallel to one another.

22. The apparatus of claim 21 wherein said blocking members are linearly elongated between opposite ends and fixedly supported at each of said opposite ends.

* * * * *